United States Patent [19]

Stewart

[11] Patent Number: 4,884,338

[45] Date of Patent: Dec. 5, 1989

[54] ELECTRIC SHAVER IMPROVEMENT

[76] Inventor: John V. Stewart, 1308 Henry Balch Dr., Orlando, Fla. 32810

[21] Appl. No.: 220,159

[22] Filed: Jul. 18, 1988

[51] Int. Cl.[4] ..... B26B 19/16

[52] U.S. Cl. ..... 30/43.92; 30/36; 30/41; 30/43.6

[58] Field of Search ..... 30/43.92, 34 R, 35, 30/36, 41, 43.6

[56] References Cited

U.S. PATENT DOCUMENTS

| | | | |
|---|---|---|---|
| 12,534 | 9/1906 | Stewart | 241/60 |
| 719,313 | 1/1903 | Drosse | 30/43.6 |
| 1,264,605 | 4/1918 | Bonham | 30/43.6 X |
| 1,543,387 | 6/1925 | Kawalle | 30/43.6 |
| 1,635,827 | 7/1927 | Frank | 30/35 |
| 1,744,006 | 1/1930 | Laws | 83/101 |
| 2,192,726 | 3/1940 | Williams | 30/34 R |
| 2,511,188 | 6/1950 | Whipple | 30/36 |
| 2,953,851 | 9/1960 | Wheeler | 30/35 |
| 3,060,571 | 10/1962 | Wahl | 30/43.92 |
| 3,183,591 | 5/1965 | Dumont | 30/34 R |
| 3,494,031 | 2/1970 | Sklenar | 30/43.6 |
| 3,696,508 | 10/1972 | Messinger | 30/43.92 |
| 4,549,352 | 10/1985 | Ochiai et al. | 30/41.6 |

FOREIGN PATENT DOCUMENTS

| | | | |
|---|---|---|---|
| 12366 | 3/1956 | Fed. Rep. of Germany | 30/43.6 |
| 2403946 | 8/1975 | Fed. Rep. of Germany | 30/43.6 |
| 1149801 | 1/1958 | France | 30/43.6 |
| 37158 | 3/1977 | Japan | 30/43.6 |
| 204018 | 7/1939 | Switzerland | 30/43.6 |

*Primary Examiner*—Frank T. Yost
*Assistant Examiner*—Y. Lin

[57] ABSTRACT

An improved cutter head design for powered shavers, resembling the blade configuration of reel type lawnmowers. Elongated blades are mounted at intervals around a rotatable cutter assembly, with the width of the blades oriented radially. The axis of blade rotation is parallel to the skin being shaved. A thin, semi-flexible perforated screen covers part of the cutter assembly. Hair inserted through the screen is cut by the rotating blades against the screen material. This design allows a toric (barrel-like) head shape, unlike the current reciprocating or rotary types, which require straight or flat shapes, respectively. A toric shape, is convex on two axes, providing a better match for the difficult facial curves at the jaw/neck junction. Difficulty in that area is where many would-be electric shaver users give up and return to the use of razor blades. Self-cleaning and self-sharpening mechanisms are described, which are made practical by this design. These increase convenience, effectiveness, and cutter life. Rotary cutter motion provides smooth, quiet operation, and allows a shorter head than reciprocating types.

11 Claims, 3 Drawing Sheets

FIG 2
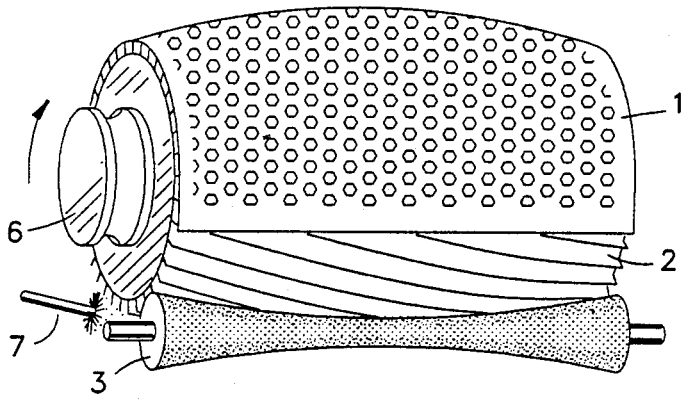
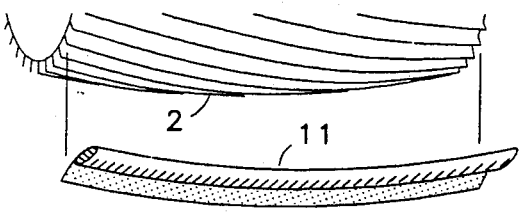
FIG 4
FIG 3
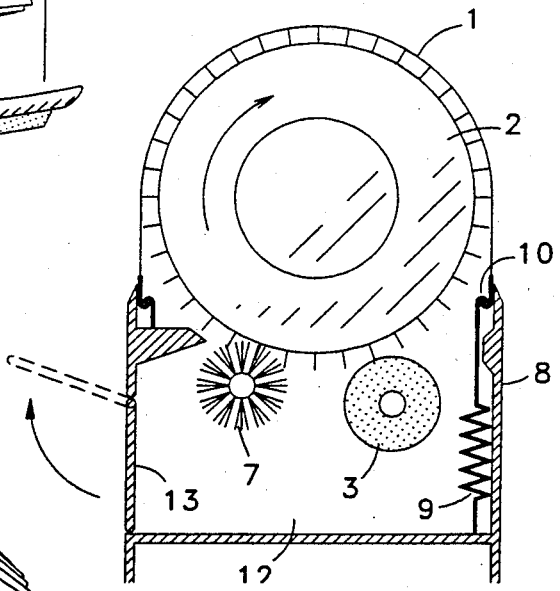
FIG 5
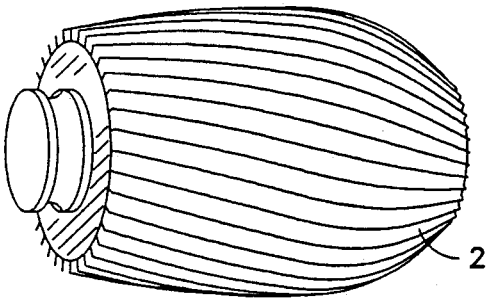

ELECTRIC SHAVER IMPROVEMENT

BACKGROUND - FIELD OF INVENTION

This invention relates to powered shavers for body hair. It also relates indirectly to reel type lawnmowers.

BACKGROUND - PRIOR ART

Men who shave know that no electric shaver currently available is fully satisfactory for facial hair. The choice between a razor blade and an electric shaver is a choice between two evils. Scraping the face repeatedly with a sharp blade is crude, hazardous, painful, time consuming, and skin damaging. However, rubbing the face many more times with the gentler but less effective electric shaver is little better. Some men have a combination of facial contour, beard density, and beard angle, which makes all available electric shavers ineffective.

One weakness in power shavers is their inability to follow face contours closely, especially at the jaw/neck junction. A razor blade contacts the skin along a short thin line, which can be easily rotated and follows contours fairly well. However, electric shavers contact a larger, less flexible area, defined by the shape of the cutter head. The range of possible shapes of electric cutter heads is constrained by their mechanisms, of which there are two major types:

One type of mechanism moves reciprocating cutter blades across a thin perforated screen which separates the blades from the skin. Hair passes through the apertures in the screen to be cut by the moving blades. The shape of this cutter type is characterized by convexity on one axis and straightness on the other. Semi cylindrical shapes or a parallel series of such shapes are generally used. Straightness on one axis is necessary to allow linear reciprocation of the cutter. This straightness inhibits contour matching, since it bridges convex areas of the face. The problem increases with the length of the head, which is lengthened by allowance for longitudinal cutter travel. A wide shaving sweep is important in power shavers, since a lower percentage of hairs are fully cut per sweep than with a razor blade. A wide sweep compensates to reduce the number of strokes per shave. For these reasons, reciprocating shaving heads are generally longer than a razor blade. The lateral curvature of a reciprocating head is a compromise between narrowness for better agility, and wideness for effectiveness. Width is needed to increase the probability that a given hair is properly positioned in a screen aperture at the right instant of cutter motion to be fully cut during a given shaving stroke. The probability of this occurrence is increased by passing multiple apertures over each point during each stroke. These considerations result in a longer and wider head than a razor blade, and one which does not follow face contours nearly as well.

Reciprocating blades must decelerate, stop, reverse direction, and accelerate. During this interval they are ineffective, and can pull hair. Thus, blade reversal must be performed very quickly. A hair which enters a screen aperture just after a reciprocating blade has passed, and just beyond the travel limit of the following blade, must wait for the former blade to return in the opposite direction. This doubles the effective distance between blades at cutter positions just beyond the limit of each blade in each direction. For these reasons, reciprocating cutter assemblies must be both fast and very quick. This requires precision power transmission and very light-weight materials for the cutter assembly and transmission components. These are practical disadvantages in design and manufacturing, and will cause even the best built shaver to vibrate and be noisy.

Another type of shaver mechanism uses rotary blades like a rotary lawnmower, except hair is cut against a mesh located between the blade and skin. The shape of this type of head must be essentially a disk. Since disks have neither a narrow axis nor a curved surface, heads may tilt to improve agility. However, the practical degree of disk tilt is small, and the total array of cutter disks defines an essentially fixed shape, which is even less agile than that of reciprocating heads. Theoretically, a rotary blade could be curved, describing a doughnut or hemispheric rotation shape. However, these shapes are even less useful than multiple disks. The center of a doughnut shape would not contact the skin, nor would much of the outer perimeter. A hemispheric rotation shape would have a non-cutting position as its first point of contact, since this point would be on the axis of rotation. Thus rotary cutters with their axis of rotation perpendicular to the shaved surface cannot have an optimum shape.

A better cutter design for power shavers is described here. It employs a barrel-shaped cutter, with the axis of rotation parallel to the skin. This is related to the blade configuration of reel type lawnmowers, which are used where clean, accurate grass cutting is important, such as on golf courses. This mechanism has some major advantages when adapted for use in power shavers as described.

OBJECTS AND ADVANTAGES

The object of this invention is an improved cutter assembly design for electric shavers, which overcomes inherent disadvantages of the current reciprocating and rotary types.

Existing cutter designs have zones of low cutter effectiveness. Such zones exist in reciprocating cutters near their ends of travel, and just past the limit of travel of each blade in each direction. Such zones exist in rotary cutters at the non-cutting center of rotation and in the space between cutters on multiple-cutter heads. These low-effectiveness zones are like weak links in a chain. In the described invention, every position on the surface of the cutter is equally effective. This makes the described cutter more effective for a given size, allowing cutters to be smaller and more agile.

Present cutter designs are restricted to straight or flat shapes in reciprocating and rotary types respectively. The invention allows convexity in both lateral and longitudinal axes, providing a better fit for difficult facial contours. The degree of convexity on each axis can be designed from a wide practical range, allowing shape optimization and product differentiation. Convexity on the longitudinal meridians may even vary from end to end, giving the user a varying contour for different areas of the face.

In this invention, the cutter blades are separated from the screen in part of their rotation. This makes self-cleaning and self-sharpening mechanisms practical, adding convenience and effectiveness, and increasing cutter life.

Cutter motion is rotational, allowing smooth, quiet operation. This invention is practical to manufacture with current technology. Lightness, speed, and quickness of the cutter assembly and power transmission is not as critical as with reciprocating designs.

Proper screen tension against the cutter is readily achieved via spring connection on the side of the cutter toward which the blades rotate as they cross the screen. This provides a natural conforming tension in the screen, which is complemented by the smooth cutter friction in the same direction. In contrast, reciprocating cutter screens require more rigidity to withstand bi-directional friction which does not complement the screen tension, since the friction force is directed 90 degrees from the tension force. With current rotary cutters, the screen must withstand a twisting friction, again not complementing its desired shape and tension, and requiring more screen rigidity.

DRAWING FIGURES:

FIG. 1 - Explosion view of major components
FIG. 2 - Partly assembled view
FIG. 3 - End view of components
FIG. 4 - Alternate sharpener embodiment
FIG. 5 - Varying longitudinal convexity
FIG. 6 - Sharpener engagement mechanism end view
FIG. 7 - Sharpener engagement mechanism, perspective view

DRAWING REFERENCE NUMERALS:

1 Perforated screen
2 Cutter barrel
3 Sharpener
4 Drive pulley
5 Drive belt
6 Driven pulley
7 Cleaner brush
8 Shaver handle
9 Screen tension spring
10 Screen installation hook
11 Sharpener embodied as a stationary strop
12 Hair collection compartment
13 Compartment access door
14 Sharpener engagement latch
15 Sharpener engagement knob
16 Optional screen release

DESCRIPTION:

FIG. 1 is an explosion view of the major components of the invention. Elongated cutter blades are mounted helically on a barrel-shaped rotating drum 2, driven by a motor via drive belt 5. Beneath the cutter assembly are a self sharpener 3, and a blade cleaner brush 7. The sharpener can be an active or passive strop or abrasive wheel, as shown, or it can be a stationary band as shown in FIG. 4. The cleaner brush can also be rotatable or stationary. A rotatable brush is preferred, since it can clean both the leading and trailing sides of the blades. These devices are placed near the bottom of the cutter, as clarified in FIG. 3.

An enhancement is to place the sharpener at bottom center, with a cleaner brush on each side of it. One brush removes hair clippings before the sharpener, improving its effectiveness, and the other removes any abrasive particles from the blades. Loose abrasion material should be minimized by the choice of blade and strop composition to protect the screen. Another enhancement is a user operable latch which engages the sharpener and the screen inversely. The sharpener can then be engaged temporarily, and the screen will be loosened automatically for its protection during sharpening. The latch can be mounted in a well on the side of the shaver.

Cutter rotation speed can be moderate if the blades are spaced closely, such as in FIG. 1, where spacing is 10 degrees. Cutter speed can be slower than on a reciprocating cutter with the same blade spacing, since reciprocation results in doubling the effective spacing, as explained in the prior art above.

The screen apertures can be various shapes. A hexagonal shape, as shown, may be optimal. By comparison to round apertures, it increases the percentage of open space for a given minimum inter-aperture spacing. It has straight edges for shearing, and corners for clipping. The hair collection swath of a hexagon can overlap that of its neighbors, and its angled sides direct hair to the clipping corners and shearing side. Aperture shape, and its angle relative to the direction of cutter rotation, should be optimized to provide the largest possible percentage of open space, yet cut each hair as closely as possible to its point of entry. The shape, size, and angle of the apertures must discourage rotation cutter blades from catching an edge of the screen material.

FIG. 2 is a partly assembled view of the most significant components shown in FIG. 1. This is for clarification of component positions.

FIG. 3 is an end view of the major components, further including a spring loaded connection hook for the screen on the side toward which the cutter rotates as it passes over the screen. This holds proper tension of the screen against the cutter blades.

FIG. 4 is a partial view showing an alternate embodiment of the sharpening strop, as a stationary band.

Figure 1:
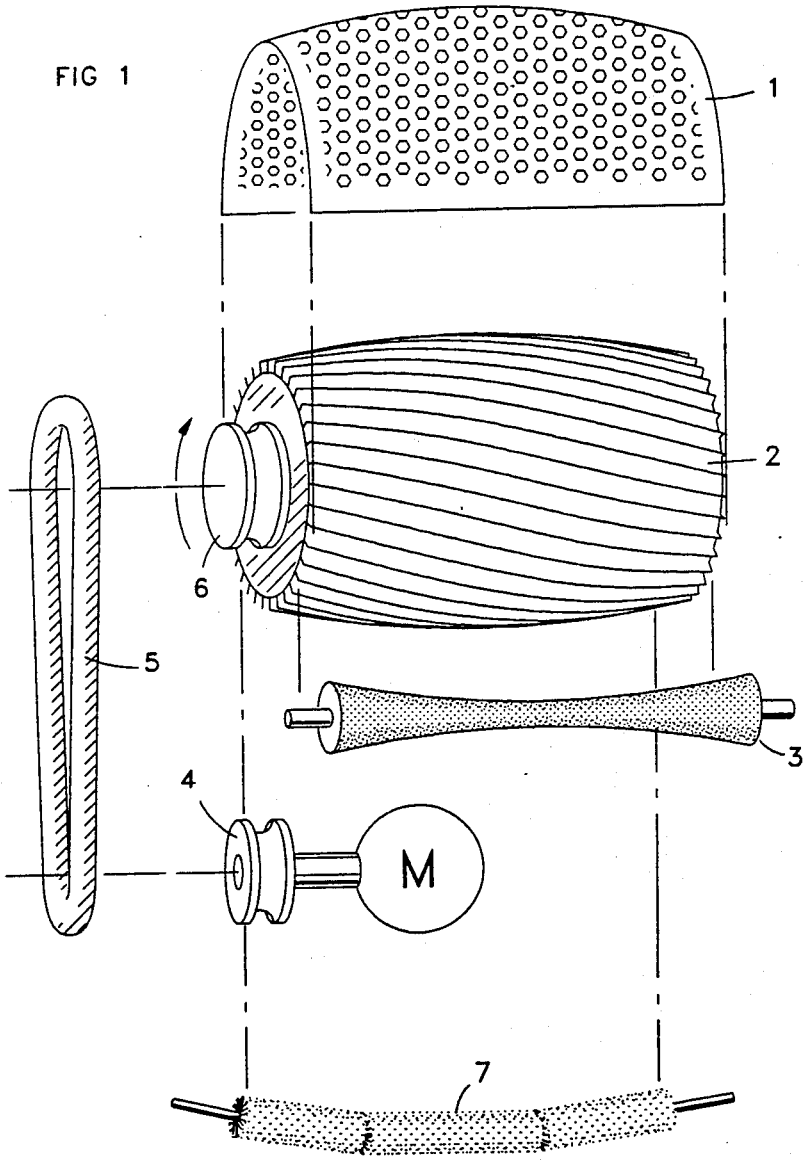
Figure 6:
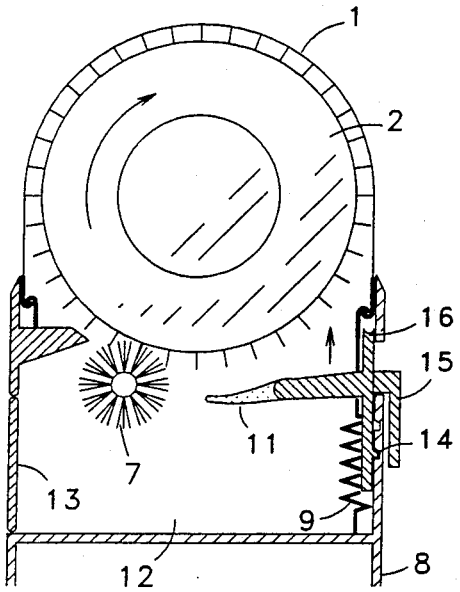
Figure 7:
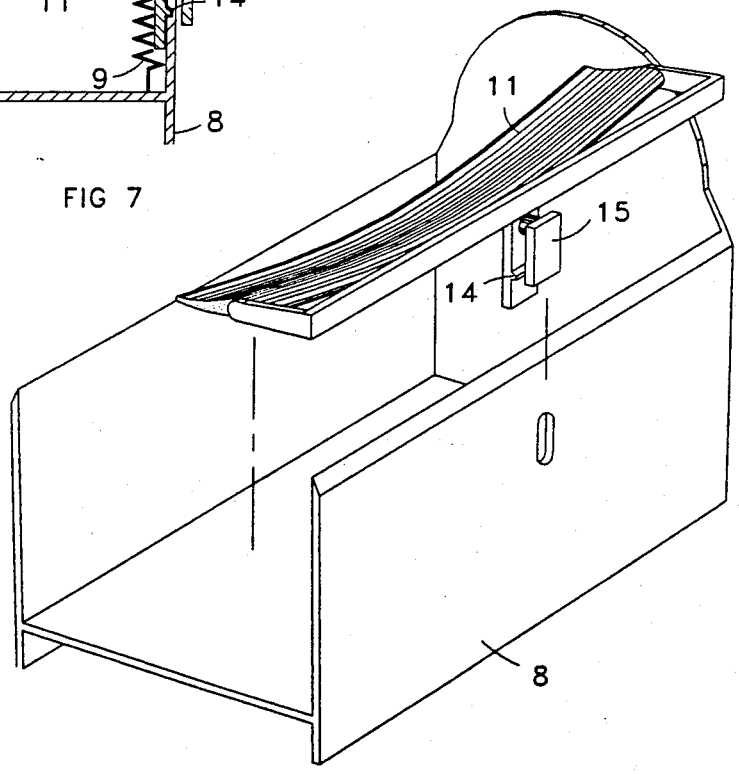

PREFERRED EMBODIMENT:

A barrel-shaped drum is used for a blade mounting, to allow narrow, stable blades and to transport hair clippings to an accumulation area. Blades are spaced at intervals of about 10 degrees around the drum, and are mounted helically.

A passively rotating strop wheel is located below the cutter assembly. It is shaped to match the cutter rotation surface at a line of contact. It is engaged via a knob or latch, mounted in a well on the side of the shaver handle, and screen tension is released during sharpening.

A passively rotating cleaner brush is located below the cutter assembly. It comprises a steel central rod, angled to approximate cutter curvature, and brush sleeves. Hair clippings are directed into an accumulation compartment. The compartment opens on one or both long sides of the shaver handle for tapping, blowing, or scraping clean. The door detents in both open and closed positions.

OPERATION:

The rotating cutter blades shear or clip hairs which pass through the screen apertures. A hair is sheared or clipped by a blade edge against the screen material surrounding the aperture through which the hair passes. Hair clippings are dislodged by a brush below the cutter assembly, and accumulate in a compartment in the shaver handle for easy disposal. A sharpening strop located below the cutter assembly contacts the blade edges during cutter rotation. Sharpening operation may be either temporarily or permanently engaged. The temporary engagement means can be designed to disengage the screen tension to protect the screen from abrasive particles.

I claim:

1. A hair shaving device, comprising:

a cutter assembly having a rotatable drum, a plurality of elongated flat blades, fixed helically in and extending radially from said rotatable drum, a thin, semi-flexible screen perforated with a matrix of apertures, part of said screen in contact with, and conforming to, part of the rotation surface of said cutter assembly, power means for rotating said cutter assembly about its axis; and a case, at one end of which is mounted said cutter and said screen, and within which is mounted said power means.

2. The device of claim 1, wherein said case includes a hair-collection compartment, positioned adjacent and oriented with a longitudinal side of said cutter assembly, said case having an access door opening onto a longitudinal side of said compartment.

3. The device of claim 1 wherein the longitudinal meridians of the surface of rotation of said cutter assembly are convex.

4. The device of claim 3 wherein the longitudinal meridians of the surface of rotation of said cutter assembly vary in curvature from end to end.

5. The device of claim 1 further including spring means for tensioning said screen laterally around said cutter assembly.

6. The device of claim 1, further including means for automatically cleaning said blades, comprising a passively rotatable brush mounted in said case, the axis of said brush approximately parallel to the axis of said cutter assembly, and the surface of said brush contacting said cutter assembly along approximately a longitudinal meridian of the rotation surface of said cutter assembly.

7. The device of claim 1, further including means for automatically sharpening said blades, comprising an elongated abrasive member, shaped and mounted to contact substantially the length of the rotation surface of said cutter assembly along at least a line of contact.

8. The device of claim 7 wherein said abrasive member is a passively rotatable abrasive wheel.

9. The device of claim 7, further including engagement means for applying said abrasive member against said cutter assembly, including a latch operable by a knob on the side of said case.

10. The device of claim 9 wherein said engagement means includes means for loosening the force of contact of said screen against said cutter assembly.

11. The device of claim 1 wherein said matrix of apertures is patterned as a simple honeycomb of hexagonal apertures.

* * * * *